US006280204B1

(12) United States Patent
Funatsu

(10) Patent No.: US 6,280,204 B1
(45) Date of Patent: Aug. 28, 2001

(54) ELECTRICAL CONNECTOR WITH MULTIPLE ROWS OF TERMINALS

(75) Inventor: Akira Funatsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/476,995

(22) Filed: Jan. 4, 2000

(30) Foreign Application Priority Data

Jun. 23, 1999 (JP) ..... 11-176793

(51) Int. Cl.[7] ..... H01R 9/09
(52) U.S. Cl. ..... 439/79; 874/876
(58) Field of Search ..... 439/79, 83, 876, 439/571

(56) References Cited

U.S. PATENT DOCUMENTS 5,928,455 * 7/1999 Dizin et al. ..... 156/276
6,007,376 * 12/1999 Shimizu ..... 439/571

* cited by examiner

*Primary Examiner*—Gary Paumen
*Assistant Examiner*—Alexander Gilman
(74) *Attorney, Agent, or Firm*—Kanesaka & Takeuchi

(57) ABSTRACT

An electrical connector comprises an insulating housing (1) having a plurality of arranging surfaces; a plurality of terminals (5, 11) having contact sections (7, 12) placed on the arranging surfaces and connection legs (9, 14) projecting rearwardly from the housing to form connection portions (10, 15) in a plane. A terminal (5) in a row has a plurality of connection legs (9) spaced laterally while a terminal (11) in another row has a connection leg (14) fitted in a space between the connection legs (9) such that the connection portions (10, 15) of the terminals (5, 11) are aligned substantially laterally in the plane.

5 Claims, 7 Drawing Sheets

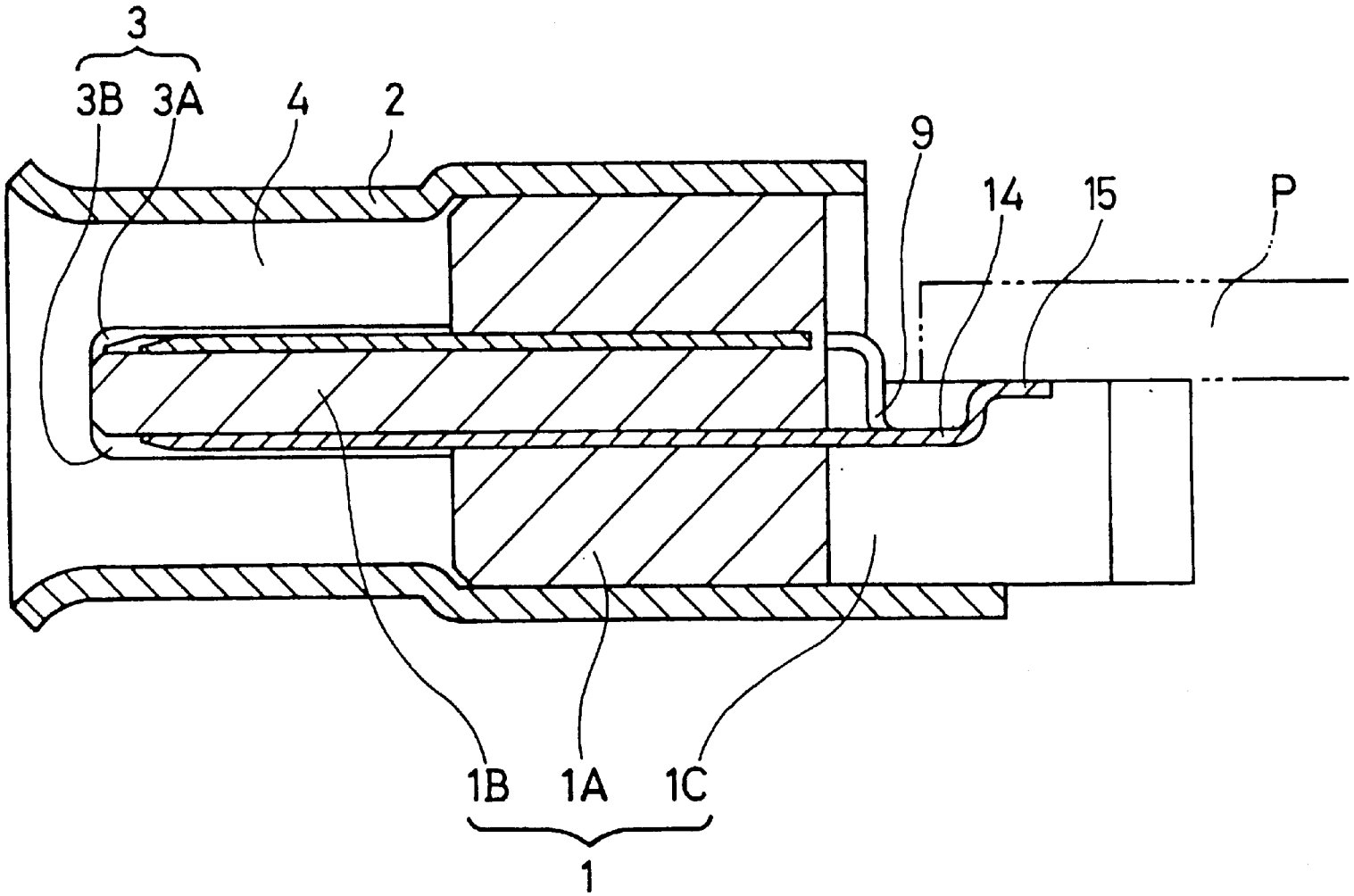
FIB. 2

FIB. 4(A)
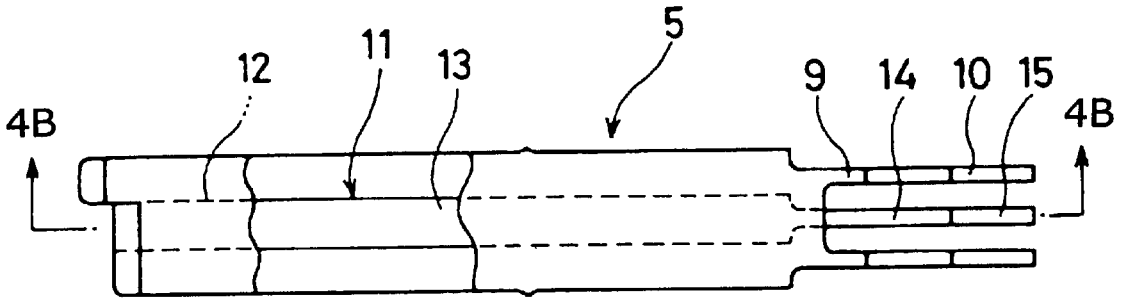
FIG. 4(B)
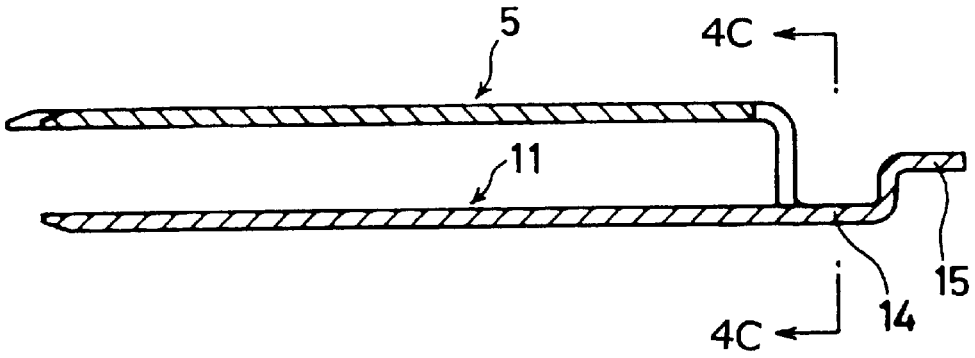
FIG. 4(C)
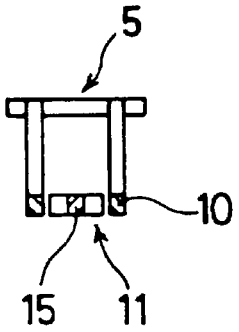

ELECTRICAL CONNECTOR WITH MULTIPLE ROWS OF TERMINALS

BACKGROUND

1. Field of the Invention

The present invention relates to electrical connectors in which terminals are arranged in multiple rows.

2. Description of the Related Art

FIG. 7 shows such an electrical connector as described above. A housing body 51 is made from an insulative material so as to extend in the direction perpendicular to the sheet. It has a support plate 52 extending forwardly from a vertically middle portion thereof. It also has upper and lower grooves 53 and 54 extending forwardly on the upper and lower surfaces of the support plate 52 and upper and lower apertures 55 and 56 communicating with the upper and lower grooves 53 and 54, respectively. Strip-like terminals 57 and 58 are inserted into the apertures 55 and 56 from the back or right-hand side of the housing body 51 or held in the molding of the housing body 51 such that the front contact sections 57A and 58A are in the grooves 53 and 54.

The terminals 57 and 58 each have a bent section 57B or 58B such that the rear connection sections 57C and 58C are aligned linearly on a circuit board P. The connection sections 57C and 58C are soldered to the corresponding traces of the circuit board P.

In use, a mating connector (not shown) is guided into the front section 59A of a rectangular casing 59 which surrounds the housing body 51 such that the terminals 57 and 58 are connected to the corresponding terminals.

However, the rear ends of the two types of terminals for the above electrical connector are disposed at two different positions, presenting the following disadvantages.

(1) A large mounting space is necessary to accommodate the two types of terminals, hindering miniaturization of the equipment.

(2) It is difficult to provide planarity of the circuit at a junction between the circuit and connection portions.

(3) The circuit tends to warp, applying a high stress to either of the connection portions and separating the soldering.

SUMMARY OF THE INVENTION

Accordingly, it is an object of the invention to provide an electrical connector having a small connection area with a circuit, realizing miniaturization of the equipment and easing the requirement for planarity of the circuit, thus proving reliable soldering.

An electrical connector relative to the invention comprises an insulating housing having a plurality of arranging surfaces; a plurality of first and second terminals having at an end contact sections placed on said arranging surfaces and at the other end connection legs projecting from the arranging surfaces to form connection portions situated in a plane.

According to the invention, the electrical connector is characterized in that at least one first terminal in an arranging surface has a plurality of connection legs spaced laterally and at least one second terminal in another arranging surface has a connection leg placed between the plurality of connection legs such that the connection portions are aligned substantially in a lateral line.

In such a structure, the connection portions of terminals on the arranging surfaces are aligned substantially in a line in a plane so that the terminals are connected to a circuit board, etc., in a short distance in the longitudinal direction of the terminals.

According to an embodiment of the invention, the first and second terminals are power and signal terminals, respectively. The power terminal has two or more connection legs with connection portions soldered to traces of a circuit board.

BRIEF DESCRIPTION OF THE DRAWINGS

FIG. 2 is a sectional view taken along line 2—2 of FIG. 1(A);

FIG. 4(A) is a top plan view, partially cutaway, of a signal terminal along with the power terminal;

FIG. 4(B) is a sectional view taken along line 4B—4B of FIG. 4(A);

FIG. 4(C) is a sectional view taken along line 4C—4C of FIG. 4(B);

DESCRIPTION OF THE PREFERRED EMBODIMENT

Embodiments of the invention will now be described with reference to FIGS. 1–6.

Figure 1A:
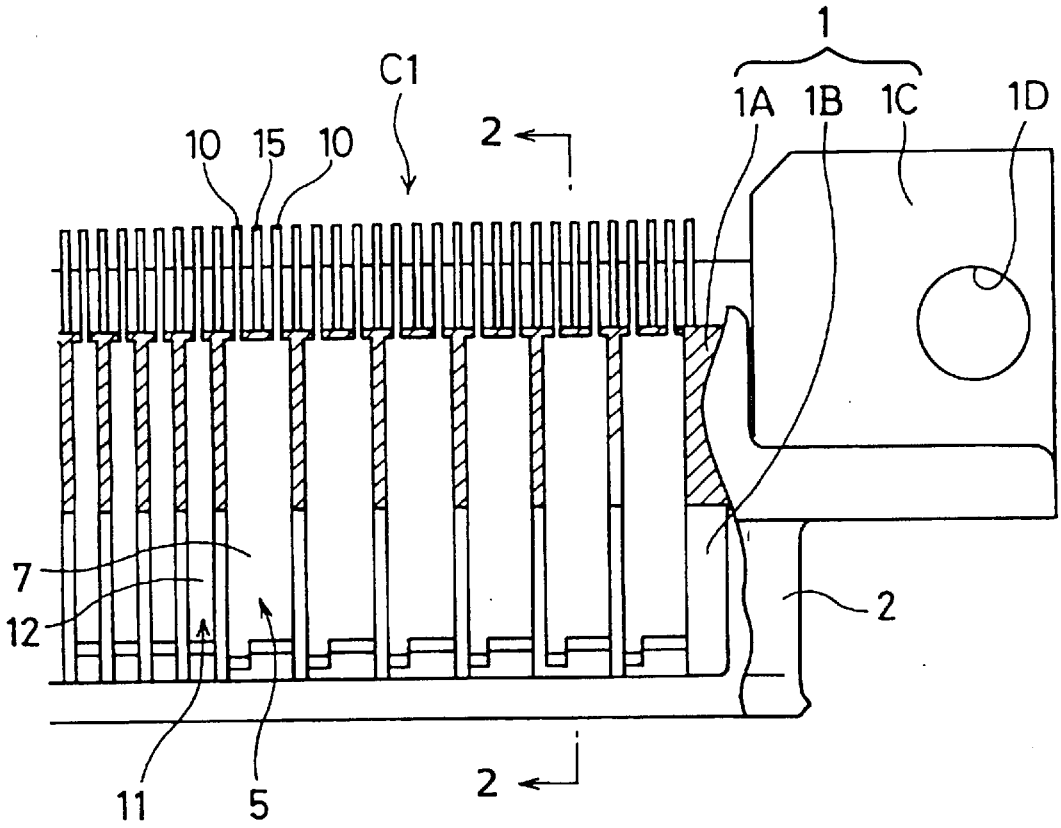
FIG. 1(A) is a top plan view, partially in section, of an electrical connector according to an embodiment of the invention.
Figure 1B:
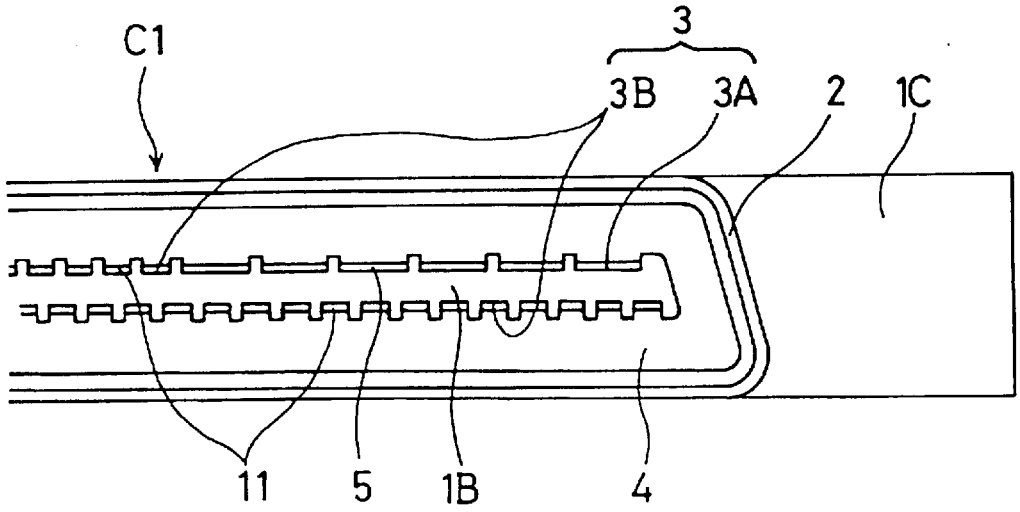
FIG. 1(B) is a front elevational view of the electrical connector.

In FIGS. 1(A), 1(B), and 2, an insulative housing 1 extends laterally and is surrounded by a metal guiding tubular member 2. The housing 1 has a body section 1A, a support plate 1B extend forwardly from the body section 1A, and a fixing section 1C projecting laterally from the body section 1A. A fixing hole 1D is provided in the fixing section 1C to screw the housing 1 to a circuit board. As best shown in FIG. 1(B), the support plate 1B is provided at substantially a half of the thickness of the housing body and has grooves 3A and 3B on upper and lower surfaces thereof for receiving narrow signal terminals and wide power terminals, respectively. The width of the power terminal grooves 3A is approximately twice the width of the signal terminal grooves 3B. The power and signal terminal grooves 3A and 3B are arranged at predetermined intervals in a half of the upper surface, and the other half and the entire lower surface of the support plate 1B, respectively. A receiving space is formed between the guiding tubular member 2 and the support plate 1B for receiving a mating connector (not shown).

Figure 3A:
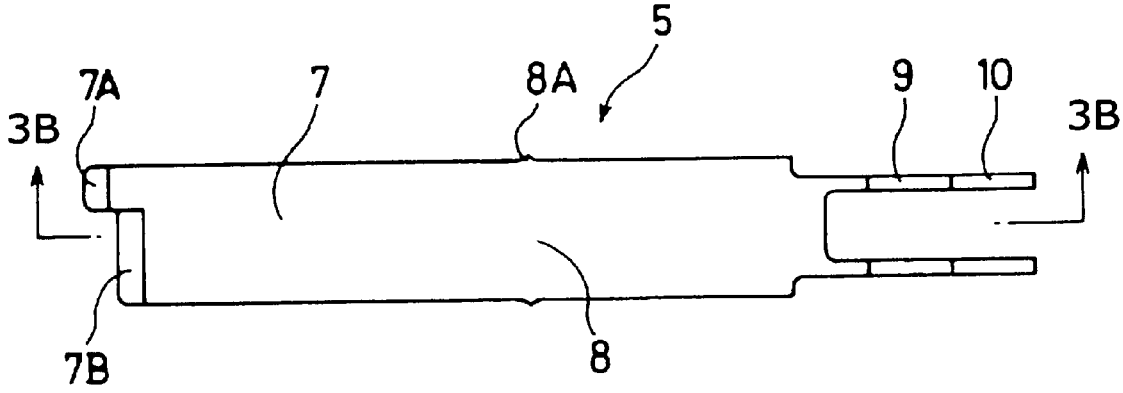
FIG. 3(A) is a top plan view of a power terminal for the electrical connector.
Figure 3B:
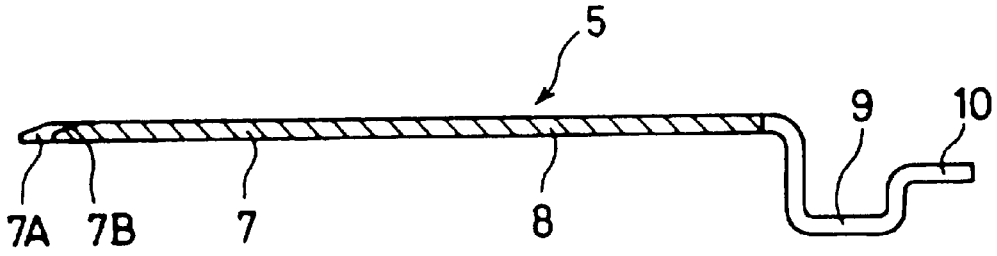
FIG. 3(B) is a sectional view taken along line 3B—3B of FIG. 3(A)

In FIGS. 3(A) and (B), a power terminal 5 is made by stamping and forming from a metal sheet so as to provide a flat contact section 7 at an end and a connection section or legs 9 at the other end. The front end of the contact section 7 is divided into two tapered portions 7A and 7B. The protruded tapered portion 7A causes a spark before connection to a mating connector. Projections 8 are provided on an intermediate section 8 for engagement with the housing 1. As best shown in FIG. 3(B), the connection legs 9 are bent such that the rear ends 10 are disposed at a position at substantially a half of the thickness of the support plate 1B. The contact section 7 is not necessarily flat but may be curved so as to provide flexibility.

In FIGS. 4(A)–(C), similarly to the power terminal 5, the signal terminal 11 is made by forming a strip of metal sheet such that it has a flat contact section 12 at an end and a connection portion 15 at the other end. As best shown in FIG. 4(C), the contact section 12 and the intermediate section 13 are narrower than the power terminal 5 so that they are fitted in a space between the connection legs 10 of the power terminal 5. The signal terminal 11 is provided with a connection leg 14 which is as wide as the connection legs 9 of the power terminal 5 and is bent to form a connection portion 15. As best shown in FIGS. 4(B) and (C), the connection portion 15 is aligned with the connection portions 10 of the power terminal 5 in the same plane when the contact portion 12 of the signal terminal 11 is placed in the groove 3B in the lower surface of the support plate 1B.

When the contact portions 7 and 12 of the power and signal terminals 5 and 11 are placed in the grooves 3A and 3B of the support plate 1B, the intermediate sections 8 and 13 are supported by the housing body 1A which is molded integrally with the support plate 1B such that the connection legs 9 and 14 project rearwardly from the body section 1A to provide the connection portions 10 and 15.

In use, the connection portions 10 and 15 of the power and signal terminals 5 and 11 are soldered to the corresponding traces of a circuit board P. Since the connections portions 10 and 15 are aligned in a line perpendicular to the longitudinal direction of the terminals, the connecting area in the longitudinal direction is reduced, thus minimizing the area which requires planarity. Even if the circuit board is warped, it has little influence on the soldering in the narrow area. It is only necessary that the connection portions 10 and 15 are aligned substantially in a line perpendicular to the longitudinal direction. Even if they are arranged in a zigzag fashion but portions thereof are overlapped widthwise, the above result is produced.

Figure 5A:
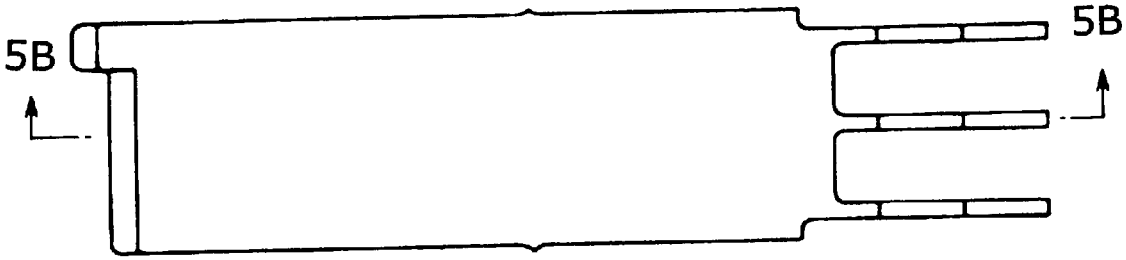
FIG. 5(A) is a top plan view of a terminal according to another embodiment of the invention.
Figure 5B:
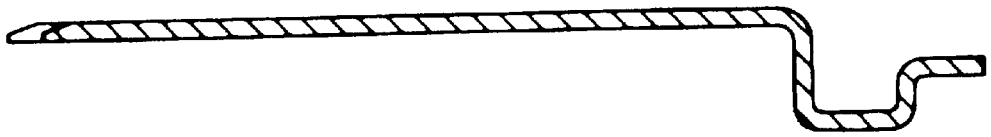
FIG. 5(B) is a sectional view taken along line 5B—5B of FIG. 5(A)
Figure 6A:
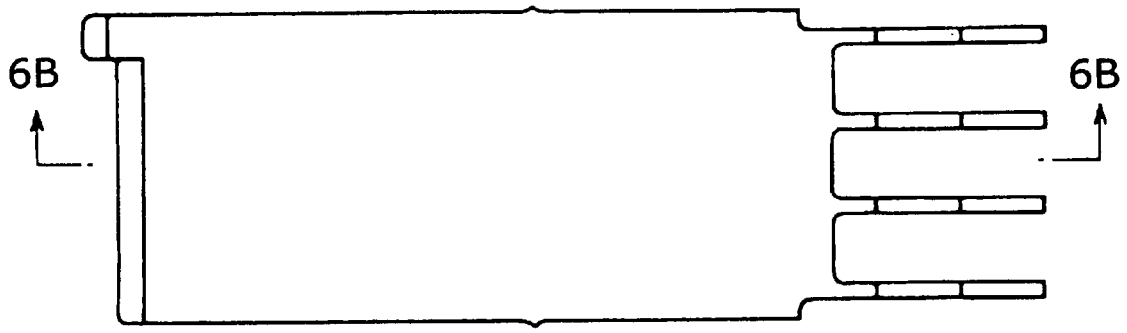
FIG. 6(A) is a top plan view of a terminal according to still another embodiment of the invention.
Figure 6B:
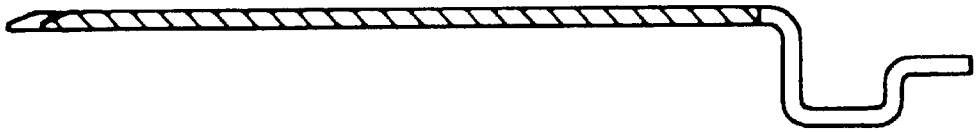
FIG. 6(B) is a sectional view taken along line 6B—6B of FIG. 6(A)
Figure 7:
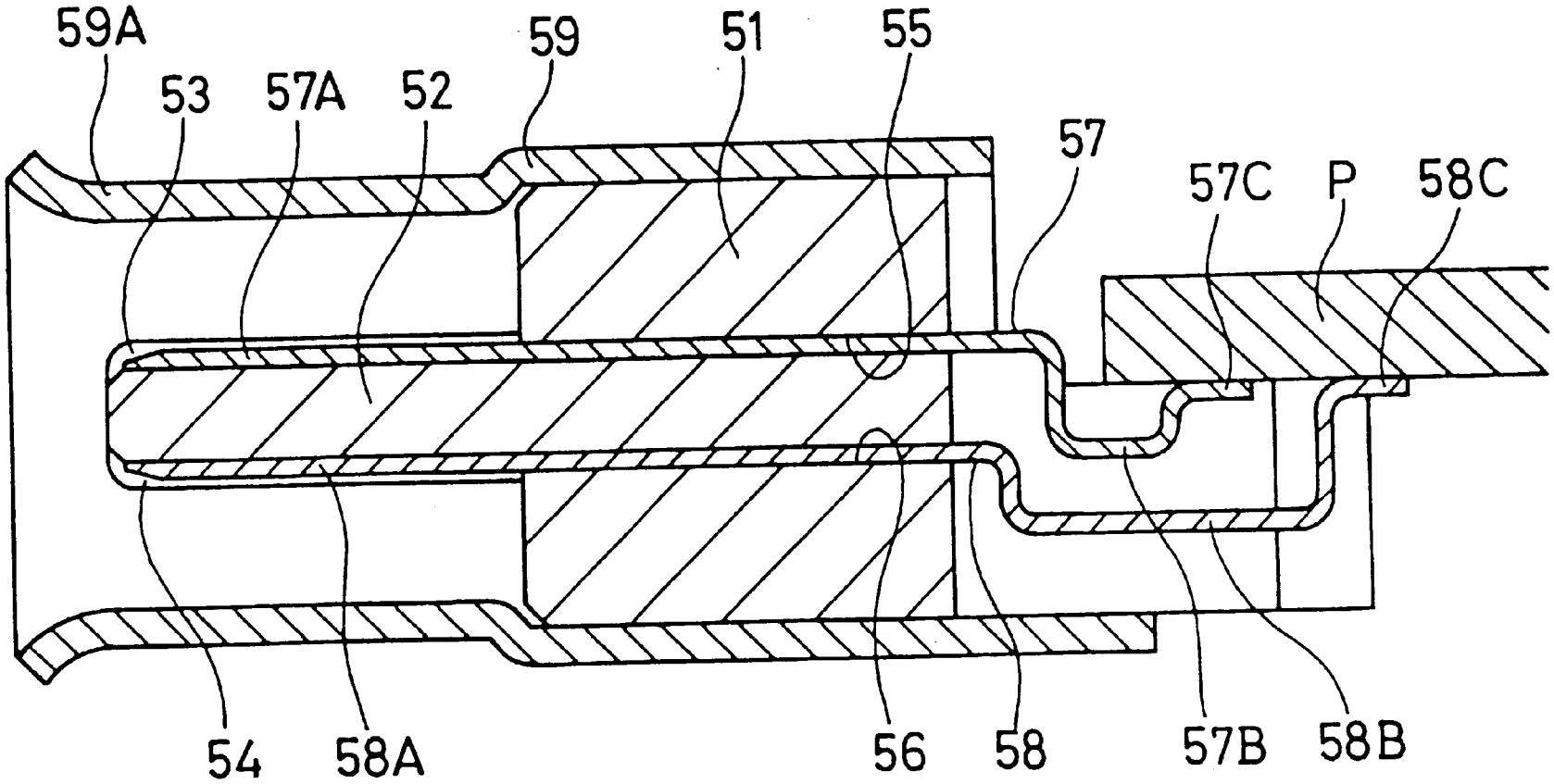
FIG. 7 PRIOR ART
FIG. 7 is a sectional view of a conventional electrical connector.

Alternatively, the power terminal may have three leg members as shown in FIG. 5, four leg members as shown in FIG. 6, or more. It is essential that the connection portion of a signal terminal provided corresponding to the power terminal is placed between the connection portions of the power terminal and aligned substantially in a line perpendicular to the longitudinal direction of the terminals. All of the terminal used may be signal terminals.

Since the connection portion of a terminal in a row is fitted in a space between connection portions of a terminal in another row and the connection portions of both the terminals are aligned in the same plane and substantially in a line perpendicular to the longitudinal direction of the terminals, it is possible to solder the connection portions in an area which is narrow in the longitudinal direction.

Consequently, it is possible to make miniaturization of the equipment and high planarity of a circuit on a circuit board. Even if the circuit is warped or flexed, it has little influence on the soldering, thus increasing the reliability.

What is claimed is:

1. An electrical connector having terminals arranged in multiple rows, comprising:

an insulating housing having a plurality of arranging surfaces;

a plurality of first and second terminals having at an end contact sections placed on said arranging surfaces and at the other end connection legs projecting from said arranging surfaces to form connection portions situated in a plane, characterized in that at least one first terminal in an arranging surface has a width greater than that of said second terminal and a plurality of connection legs spaced laterally and at least one second terminal in another arranging surface has a connection leg placed between said plurality of connection legs such that said connect portions of said first and second connection terminal legs are aligned substantially lateral line.

2. An electrical connector according to claim 1, wherein said first and second terminals are power and signal terminals, respectively.

3. An electrical connector according to claim 2, wherein said power terminal has two connection legs with connection portions soldered to traces of a circuit board.

4. An electrical connector according to claim 2, wherein said power terminal has three connection legs with connection portions soldered to traces of a circuit board.

5. An electrical connector according to claim 2, wherein said power terminal has four connection legs with connection portions soldered to traces of a circuit board.

* * * * *